US005178299A

United States Patent [19]

Mundt

[11] Patent Number: 5,178,299

[45] Date of Patent: Jan. 12, 1993

[54] NEWSPAPER VENDING MACHINE

[76] Inventor: Duane H. Mundt, 4105 S. Liberty Ave., Tucson, Ariz. 85714

[21] Appl. No.: 871,131

[22] Filed: Apr. 20, 1992

[51] Int. Cl.[5] ..... B65H 3/26

[52] U.S. Cl. ..... 221/232; 221/226; 221/240

[58] Field of Search ..... 221/226, 232, 240, 270, 221/276

[56] References Cited

U.S. PATENT DOCUMENTS

| | | | |
|---|---|---|---|
| 1,506,813 | 9/1924 | Camelo et al. . | |
| 2,006,100 | 6/1935 | Hight et al. | 312/51 |
| 2,501,434 | 3/1950 | Cameron | 221/232 |
| 2,832,506 | 4/1958 | Hatcher | 221/103 |
| 3,318,478 | 5/1967 | Hart | 221/227 |
| 3,709,405 | 1/1973 | Harris | 221/209 |
| 4,501,379 | 2/1985 | Halone et al. | 221/221 |
| 4,770,321 | 9/1988 | Anderson | 221/100 |

FOREIGN PATENT DOCUMENTS

| | | | |
|---|---|---|---|
| 706238 | 3/1965 | Canada | 221/240 |

*Primary Examiner*—H. Grant Skaggs

*Attorney, Agent, or Firm*—Antonio R. Durando; Harry M. Weiss

[57] ABSTRACT

A newspaper vending machine that is used for dispensing a single newspaper copy out of a stack stored in an enclosed magazine in response to a fixed payment by a user. The machine consists of a secure housing containing a storage compartment or magazine, where the newspapers are stacked on a spring-loaded horizontal platform that causes the top newspaper to be always positioned at the same level of a dispensing slot in the housing. The top newspaper is moved from the stack and one of its corners is exposed through the slot by means of a movable finger that catches the fold of the paper and pushes it through the slot a sufficient distance to make it accessible to a purchaser. The motion of the finger is controlled by a manually-operated vertical lever mounted at a slant with respect to the stack of newspapers, so that the finger automatically clears the stack when the lever is in a retracted position. The motion of the lever is controlled by a coin acceptor mechanism, which releases the lever for one cycle of travel when payment is made.

20 Claims, 4 Drawing Sheets

NEWSPAPER VENDING MACHINE

BACKGROUND OF THE INVENTION

1. Field of the Invention

This invention pertains to the general field of vending machines for articles of consumption in public places. In particular, it describes a new and improved mechanism for dispensing newspapers from a vending machine.

2. Description of the Prior Art

Newspaper vending machines have been part of the American scene for a long time and have been used to dispense all kinds of magazines and newspapers to the public. They can normally be found on street corners and in public places, such as bus stations, airports, and the like, and they typically consist of a secured enclosure where folded newspapers are stored for release to a purchaser either automatically or by allowing access to the papers in response to the deposit of a predetermined payment in the form of a coin or token.

Halone et al. U.S. Pat. No. 4,501,379 (1985) shows a newspaper dispensing apparatus that consists of a spring-loaded stack of papers in an enclosed container that is not accessible to the public. The newspapers are extracted through an apposite slot, one by one, after payment of the appropriate purchase price. The extraction is effected by two mechanical fingers that grab the fold of the paper and pull it forward toward the slot, far enough out for a purchaser to be able to reach it and fully remove it. The fingers work on a horizontal plane with a motion provided by a carriage driven by a lever actuated by the purchaser of the paper.

Hatcher U.S. Pat. No. 2,832,506 (1958), Hart U.S. Pat. No. 3,318,478 (1967), Harris U.S. Pat. No. 3,709,405 (1973) and Anderson U.S. Pat. No. 4,770,321 (1988) all disclose similar machines to dispense magazines and newspapers without permitting direct access to them. Camelo et al. U.S. Pat. No. 1,506,813 (1924) and Hight et al. U.S. Pat. No. 2,006,100 (1935) describe various mechanisms for extracting a folded newspaper from a stack stored in the vending machine. All of these patents consist of fairly complicated mechanical systems requiring sophisticated assemblies of specially designed components. Therefore, the resulting vending machines are expensive to manufacture.

Although not found during the course of a patent search, the prior art also includes machines that do not automatically dispense a newspaper to a user; instead, they provide access to the newspapers through a hatch released by payment of the appropriate fee into a coin acceptor. Once activated, the hatch is released and the user has full access to all newspapers stored in the machine until the hatch is closed again. Therefore, more than one paper may be taken with a single payment.

Thus, there is still a need for a vending machine that limits access to one newspaper at a time and that is implemented with an economically manufactured design. The present invention is directed at fulfilling these functions by providing a much simplified mechanism for extracting a single newspaper from the stack stored in the vending machine.

BRIEF SUMMARY OF THE INVENTION

Accordingly, one objective of this invention is the development of a newspaper vending machine that incorporates a much simplified mechanism than found in prior art for permitting the extraction of a newspaper from a stack stored in the machine upon payment of the required fee.

Another goal of the invention is a control system that permits a user of the machine to extract a single copy of the newspaper at a time.

A further goal of the invention is a machine that is self-contained and entirely mechanical, so that it is capable of providing the required functions without the necessity of connection to a source of power.

Yet another objective of the invention is a machine with a minimum of moving parts, so that it can operate continuously and for long periods of time without scheduled maintenance, other than to refill the newspaper magazine, in order to fulfill the requirements of isolated and possibly remote vending locations.

Finally, a further goal of the invention is the realization of the above mentioned goals in an economical and commercially viable manner, which is achieved by utilizing a very simple design and components that are either already available in the open market or that can be produced at competitive prices.

To the accomplishment of these objectives, this invention consists of a newspaper vending machine for dispensing a single newspaper copy out of a stack stored in an enclosed magazine in response to a fixed payment by a user. The machine consists of a secure housing containing a storage compartment or magazine, where the newspapers are stacked on a spring-loaded horizontal platform that causes the top newspaper to be always positioned at the same level of a dispensing slot in the housing. The top newspaper is moved from the stack and one of its corners is exposed through the slot by means of a movable finger that catches the fold of the paper and pushes it through the slot a sufficient distance to make it accessible to a purchaser. The motion of the finger is controlled by a manually-operated vertical lever mounted at a slant with respect to the stack of newspapers, so that the finger automatically clears the stack when the lever is in a retracted position. The motion of the lever is itself controlled by a coin acceptor mechanism, which releases the lever for one cycle of travel when payment is made.

Various other purposes and advantages of this invention will become clear from its description in the specifications that follow, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

The heart of this invention lies in the idea of providing a single-lever mechanism for extracting a newspaper from a stack stored in a vending machine. By virtue of this simplified mechanism, the operation of the machine is achieved with a small number of moving parts, thus greatly reducing the cost of production and improving its reliability.

Figure 1:
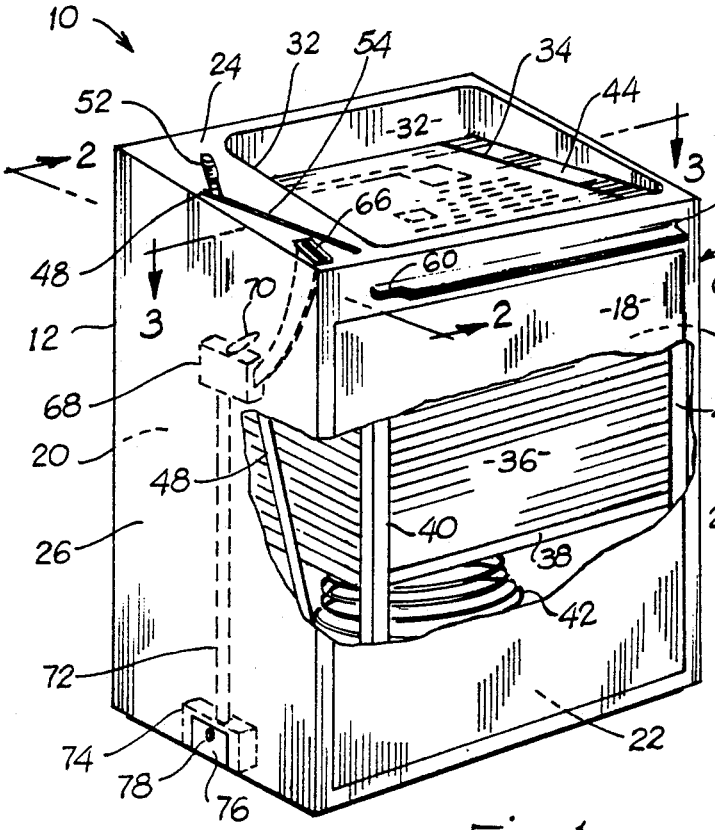
FIG. 1 is a perspective view of a newspaper vending machine according to the present invention including a cut-out portion for illustration of the interior components of the machine.

Referring to the figures, wherein like parts are referred to with like numbers and symbols, FIG. 1 illustrates the preferred embodiment of the newspaper vending machine 10 of this invention. The machine comprises a box-shaped housing or cabinet 12 that consists of a front wall 16, a rear wall 20, a bottom panel 22, a top panel 24, a left wall 26, and a right wall 28. The front wall 16 includes a removable front door or panel 18. Within the top panel 24, the housing comprises a window opening 30 encasing a transparent panel 32 that is fixedly connected to the housing for viewing the top portion of the front page of the top newspaper 34 of a stack of newspapers 36 stored in the interior of the machine.

Figure 2:
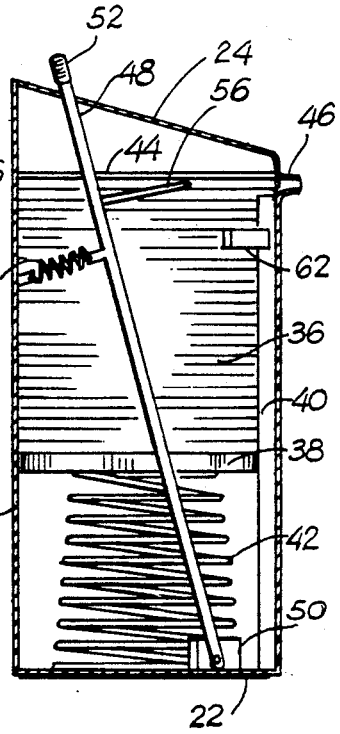
FIG. 2 is a sectional elevational view of the same vending machine taken from line 2—2 in FIG. 1.
Figure 3:
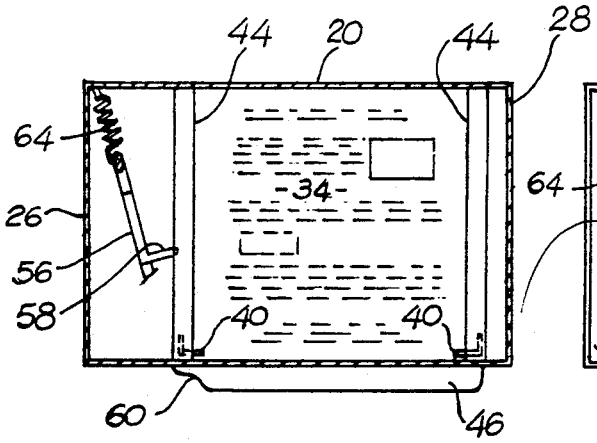
FIG. 3 is a sectional top view of the same vending machine taken form line 3—3 in FIG. 1 and showing the components in the upper portion of the machine.

As better viewed in FIG. 2, which is a cross-sectional elevational view taken from the left side of the vending machine 10 (illustrating the machine essentially as it would appear after removal of the left wall 26 and of any hardware attached to it), the vertical stack of newspapers 36 is supported by a spring-loaded rectangular tray 38 that is mounted between the back wall 20 and two vertical guides 40 positioned to receive and slidably accommodate the front corners of the tray. Of course, the tray 38 is sized to receive the format of newspaper to be dispensed by the machine. The guides 40 may consist of any vertical structure enveloping the corners of the tray, such as segments of angle iron anchored to the front wall of the cabinet, so as to contain the tray and permit its motion along a vertical path of travel. A compression spring 42 is mounted between the bottom panel 22 of the cabinet and the tray 38 in order to push the tray upward along its vertical path to cause the top newspaper 34 in the stack to always be positioned at the top end of such path of travel. As also seen in FIG. 3, two transverse horizontal slats 44, anchored between the back and front walls of the cabinet, function as travel stops and retainers for the side edges of the top newspaper in the stack. The slats are positioned at a level flush with the top edge of a dispensing slot 46 in the front wall 16 of the cabinet (see FIG. 2) and slightly above the top end of the guides 40, so that enough clearance exists for one newspaper to slide forward and out of the cabinet through the slot.

While the method of spring loading the tray 38 is illustrated here in the form of a compression spring (of the kind shown in the Halone et al. and Hatcher patents, above), any equivalent system that would cause the tray to move upward and cause the top newspaper to be aligned with the dispensing slot could be used as well to practice the invention. Many such systems are shown in the prior art, as illustrated in the various patents referenced above. For example, the Harris patent illustrates a ratcheted pulley system that elevates the tray supporting the papers a set distance every time a paper is dispensed. Similarly, the Hart patent describes a spring loaded pulley connected to the tray by a pair of lifting cables.

Thus, as a result of its structural configuration, the tray 38 is always exerting an upward pressure on the stack of newspapers 36 supported by it, so that the top newspaper 34 in the stack is in place for view by a purchaser through the window 30 and for dispensation through the slot 46. As the top paper is removed, the stack is pushed upwards against the slats 44 and the next paper becomes lined up with the slot for the next purchase. Of course, the spring 42 must be capable of pushing the tray 38 all the way to the top of its travel along the guides 40 in order to ensure the availability of all newspapers in the stack. As required, the stack can be replenished by removing the front door 18, which provides full access to the tray 38. Old papers can be removed and a new stack of papers can be loaded simply by pushing the tray down and extracting and inserting the papers through the opening between the two guides 40. Note that the papers must be loaded with the fold facing the dispensing slot 46.

As mentioned above, this invention consists of an improvement in the way each newspaper is removed from the stack and dispensed to a purchaser through the slot in the front portion of the machine. Typically, the mechanisms used in the prior art operate on the principle of exerting frictional force uniformly on both sides of the newspaper at the end of a stack (which could be either the top or the bottom paper in the stack) so as to cause it to slide out of the stack to a point within reach of a purchaser. For instance, the frictional force may be implemented through a rotating drum (see the Hight patent), or a set of parallel feet (Anderson patent); other mechanisms use push plates (Harris) and lateral fingers (Halone et al.) to grab one paper at a time and push it or pull it, respectively, out of the stack. All of these dispensing mechanisms are mechanically complex, involving numerous moving parts, and are therefore subject to high manufacturing and maintenance costs.

The dispensing assembly of the present invention consists of a single horizontal finger mounted on a vertical lever in such a way that it is capable of penetrating one corner of the fold of the top newspaper in a stack and slide it through a dispensing slot to a point where a purchaser can grab it and fully extract it from the machine. The entire mechanism comprises only one moving part: the lever itself. As illustrated in FIGS. 1-3, the dispensing lever 48 is hingedly mounted (through a bolt, rivet, or equivalent fastener) in a generally vertical position on a support block 50 rigidly attached to the bottom panel 22 of the cabinet 12. The lever 48 is sufficiently long to expose a handle 52 at its top end through a lever slot 54 in the cabinet's top panel 24. The block 50 is positioned at an angle with respect to the side walls of the cabinet, so that the arc formed by the motion of the lever, as it travels within the path allowed by the lever slot 54, lies on a vertical plane forming a specific acute angle with the side walls (as further detailed below). As an integral part of the lever 48, an arm 56 protrudes forward at an approximate 90 degree angle from the lever on the vertical plane described above, and a finger 58 protrudes inward from the tip of that arm in a direction orthogonal to the same vertical plane. Thus, the result is a horizontal and approximately L-shaped member rigidly attached to the lever 48 and facing the front of the cabinet. The exact position of the plane containing the lever 48 (as it pivots around its hinge) and the precise dimensions of the arm 56 and finger 58 are chosen so that the tip of the finger 58 is aligned with the left edge of the slat 44 (and therefore also with the left edge of the top newspaper in the stack ) when the lever is fully retracted to its most backward position (as illustrated in FIG. 3). Furthermore, the arm 56 is affixed to the lever 48 at the precise elevation required to cause the tip of the finger 58 to correspond to the level of the fold of the top paper 34 in the stack stored in the machine. Of course, this elevation corresponds to the position of the slat 44 offset by the average thickness of a newspaper. The exact angle of the lever 48 (and therefore the exact position of the block 50 attached to the bottom panel of the cabinet) is chosen so that the arm 56 is able to penetrate the opening in the slot 46 (see FIGS. 2 and 3), as well as the horizontal space between the slat 44 and the top end of the guide 40 (see FIG. 2), as the lever is pulled forward to its extended position, so that the arm protrudes out of the cabinet through a portion of the slot.

Figure 4:
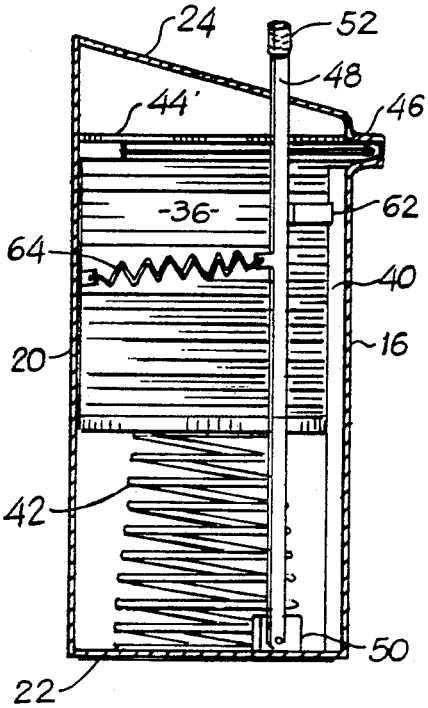
FIG. 4 is the same view illustrated in FIG. 2 showing the dispensing lever in an extended position.
Figure 6:
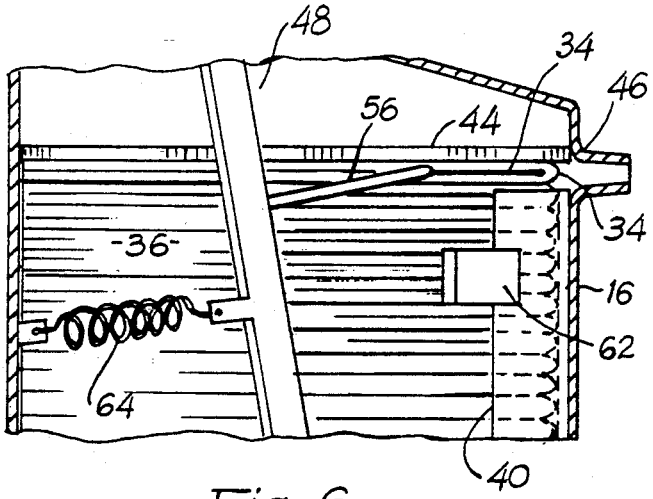
FIG. 6 is an enlarged side view of the dispensing assembly portion of the same vending machine illustrating the relative position of the dispensing arm and finger with respect to the top newspaper when the dispensing lever is fully retracted.
Figure 8:
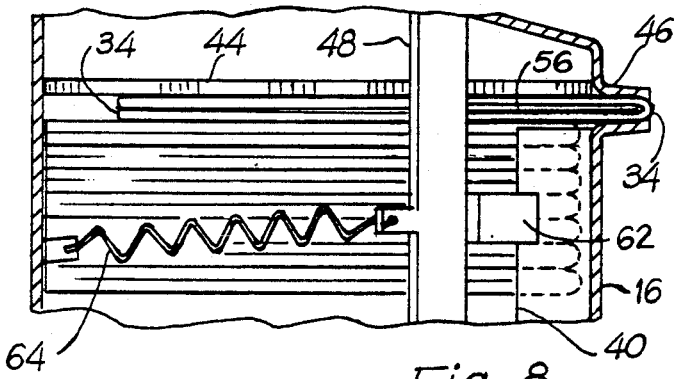
FIG. 8 is an enlarged side view of the dispensing assembly portion of the same vending machine illustrating the relative position of the dispensing arm and finger with respect to the top newspaper when the dispensing lever is fully extended.
Figure 7:
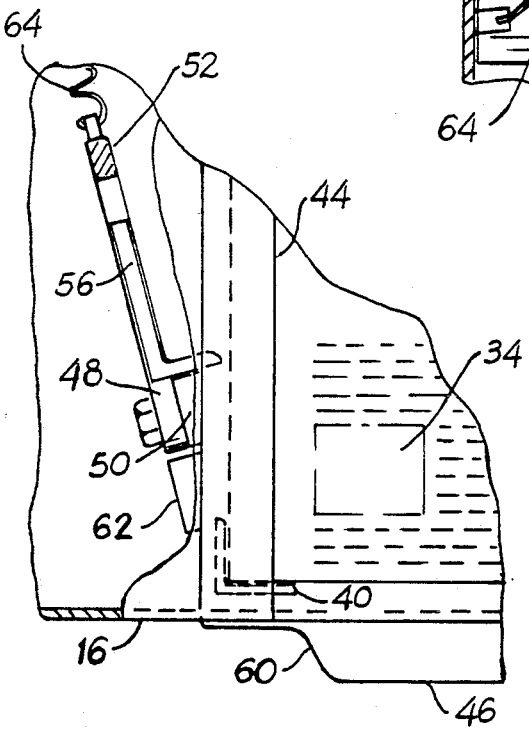
FIG. 7 is an enlarged top view of the dispensing assembly portion shown in FIG. 6.
Figure 13:
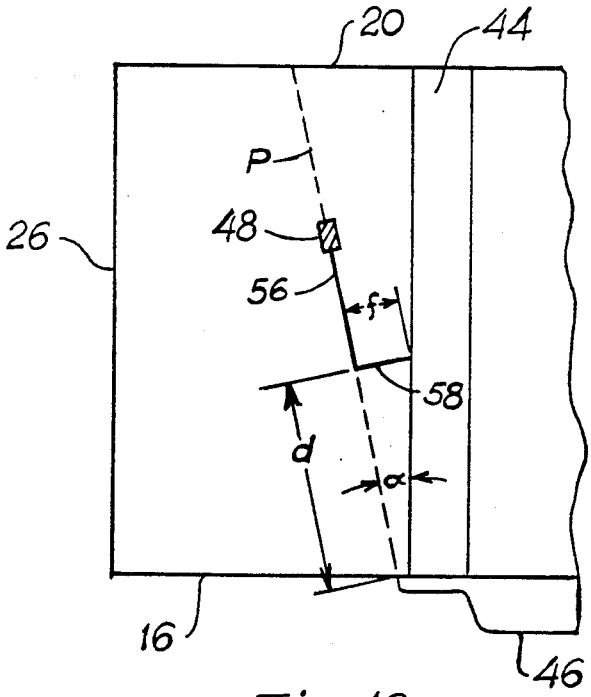
FIG. 13 is a schematic representation of the geometrical relationship between the dispensing arm, finger and lever of the invention.

Thus, the position of the lever and the size of the various components can be varied so long as these design parameters are followed. In general terms, the arm 56 must be sufficiently long to penetrate the slot 46 when the lever is operated and the finger 58 must be sized to abut the slat 44 when the lever is retracted at rest. Therefore, as illustrated in schematic form in FIG. 13, for a given distance d between the dispensing slot and the rest position of the dispensing arm, the relationship between the length f of the finger and the angle $\alpha$ between the vertical plane p of motion of the lever and the side walls of the cabinet (and therefore also the transverse slat 44) is given by $f=d \tan(\alpha)$. In addition, although not critical to the invention, it is found that the best location for the support block 50 is one that results in the dispensing lever 48 being vertical when it is fully extended in its travel (as shown in FIG. 4). Finally, the portion of the dispensing slot 46 corresponding to the location traveled by the dispensing finger as the lever is pulled forward (the left side in the embodiment shown in the figures) is shaped to feature a partially cut notch 60 to permit the partial exposure of the finger 58 when fully extended forward.

It is desirable that the finger 58 be flat with a relatively fine forward edge facing the front of the machine in order to ensure its penetration into the fold of the top newspaper when the dispensing lever is pulled forward. Both arm and finger must also be sufficiently rigid and strong to withstand the force required to push the paper forward without suffering distortion or damage from repeated use. Thus, when the lever 48 is pulled forward, the finger 58 engages the left corner of the fold of the top newspaper and pushes it through the slot so that the corner of the newspaper becomes visible and accessible through the notch 60, from where a purchaser can pull it out of the machine. A more detailed view of the functioning of the dispensing finger is given in FIGS. 6-9.

Figure 5:
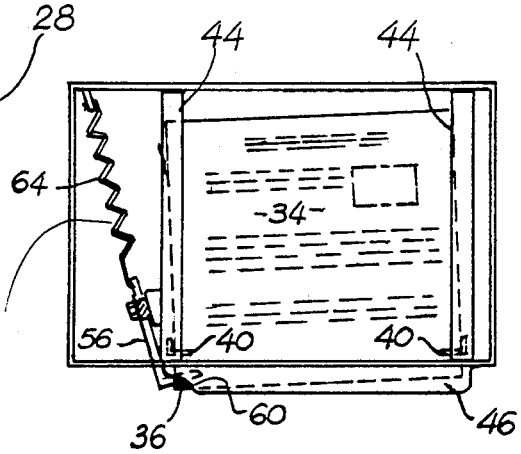
FIG. 5 is the same view illustrated in FIG. 3 showing the dispensing lever in an extended position.
Figure 9:
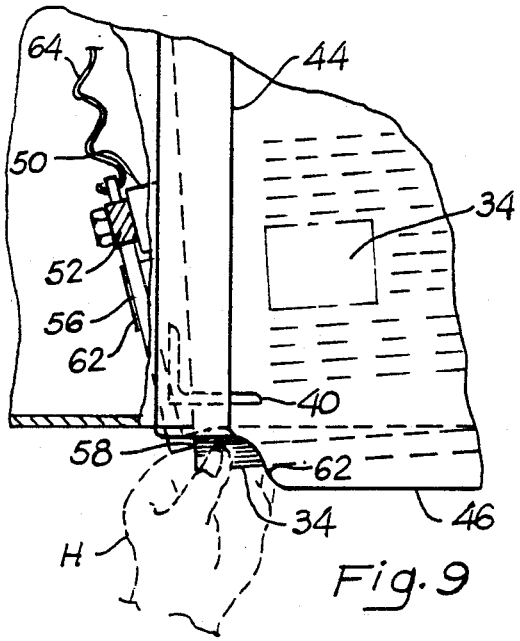
FIG. 9 is an enlarged top view of the dispensing assembly portion shown in FIG. 8.

In order to better control the travel of the dispensing lever 48 as it is being pulled forward by a user of the machine, a stop block 62 (not shown in FIGS. 3 and 5) is mounted on the guide 40 (or anywhere else on the frame of the cabinet within the travel path of the lever) in order to stop the extension of the finger 58 at the most desirable point through the slot 46, namely at the point where the top newspaper 34 is sufficiently exposed through the notch 60 for the hand H of a purchaser to be able to grab it and pull it out of the machine (see FIG. 9). In addition, in order to facilitate the return of the dispensing lever to its retracted position after it is released by a user, an extension spring 64 is mounted between the lever and the back wall of the cabinet (along the plane defined by the lever's motion) so that the lever remains automatically in its retracted position unless pulled by a user against the force exerted by the spring.

As illustrated in FIG. 1, since dispensing machines are normally used to sell newspapers in exchange for a fixed payment, the machine 10 is also equipped with a standard coin slot 66 feeding a coin acceptor 68 that automatically releases the dispensing lever 46 when payment is made. This can be implemented, for example, by a stop lever 70 pivotally connected to the coin acceptor and normally positioned in the path of travel of the dispensing lever 48 so as to impede its full forward extension. When payment is made, the coin acceptor is activated, freeing the stop lever to pivot out of the way, so that the operation of the dispensing lever is released for one cycle. The coins or tokens used for payment are then dropped by the coin acceptor via an enclosed channel 72 into a storage receptacle 74, from where they can be retrieved through a hinged door 76 secured by a lock 78.

Automatic means for activating the operation of mechanical devices in response to the deposit of money, including the delivery of exact change, are well known in prior art and widely used in newspaper vending machines. Therefore, no detailed explanation is believed to be necessary for the purposes of this invention, which is directed primarily at the newspaper dispensing mechanism.

Figure 10:
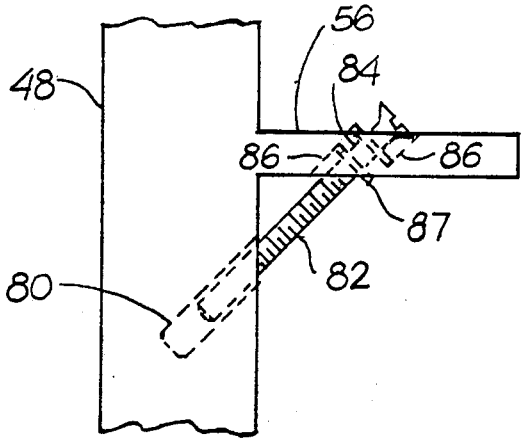
FIG. 10 is a side elevational view of the dispensing lever/arm combination of the invention incorporating a screw adjustment for the elevational position of the dispensing finger in relation to the dispensing lever.
Figure 11:
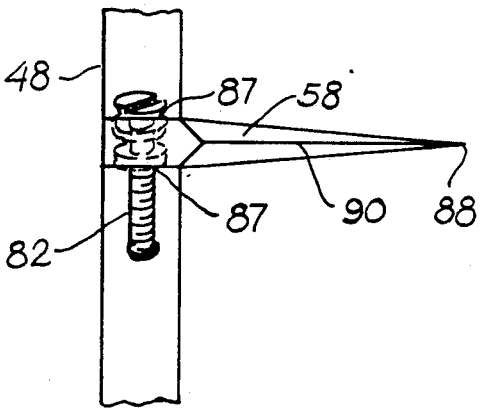
FIG. 11 is a front elevational view of the dispensing lever/arm combination and screw adjustment of FIG. 10.

In order to provide a means for calibrating the exact position of the finger 58 in relation to the exact location of the fold in the top newspaper of the stack, which may be required from time to time to correct misalignments caused by use or to adjust the equipment for papers of materially different thickness, a screw adjustment can be incorporated into the arm 56 as illustrated in FIGS. 10 and 11. A threaded channel 80 is machined into the lever 48 at approximately 45 degrees for receiving a threaded screw 82 inserted through an unthreaded coaxial channel 84 machined into the arm 56. The two channels are so sized and aligned that the screw 82 may be freely passed through the channel 84 and extended to the point where its threads engage the threads of the channel 80, so that the screw can be screwed into or out of the channel 80 by rotating it clockwise or counterclockwise, respectively. Square notches 86 are cut at both ends of the channel 84 in the arm 56 in order to accommodate snap rings 87 fitted in corresponding apposite grooves in the screw (not shown in the drawings) in order to prevent its longitudinal movement in relation to the arm 56. As a result of this structural configuration, the screw 82 is free to rotate within the channel 84 while the snap rings 87 prevent its longitudinal movement with respect to the arm 56, so that the screw's rotation causes the arm to advance or retreat with it in relation to the lever 48, depending on the direction of rotation. Thus, the exact angle between the arm and the lever, which is approximately 90 degrees, can be adjusted by pulling the arm downward or pushing it upward causing the finger 58 to also move down or up with it. Obviously, this adjustment results in a corresponding adjustment of the location of the tip 88 of the finger 58, which has to be aligned with the fold of the top newspaper for the proper functioning of the machine. As illustrated in FIG. 11, the functioning of the finger 58 is also enhanced by the presence of a fine edge 90 in its forward portion, which facilitates insertion of the finger into the fold of the paper as the dispensing lever is pulled forward.

Figure 12:
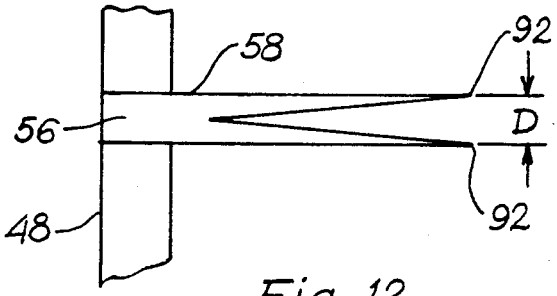
FIG. 12 is a front elevational view of the dispensing lever/arm combination of the invention illustrating a two tip embodiment for the dispensing finger.

A different embodiment for the arm/finger combination is shown in FIG. 12. The finger 58 comprises a bifurcated end with two parallel tips, separated by a distance D approximately equal to the average thickness of the papers sold by the vending machine. By positioning the top tip 92 so that it loosely touches the underside of the slat 44 (see FIGS. 3 and 7) when the dispensing arm is in its retracted position, the bottom tip 94 is automatically lined up with the fold of the top newspaper in the stack. Therefore, so long as the finger is in contact with the slat, this configuration ensures its proper position to engage the correct newspaper in the stack. Of course, an adjustment similar to the one described in FIGS. 10 and 11 can be used for this embodiment as well.

Figure 14:
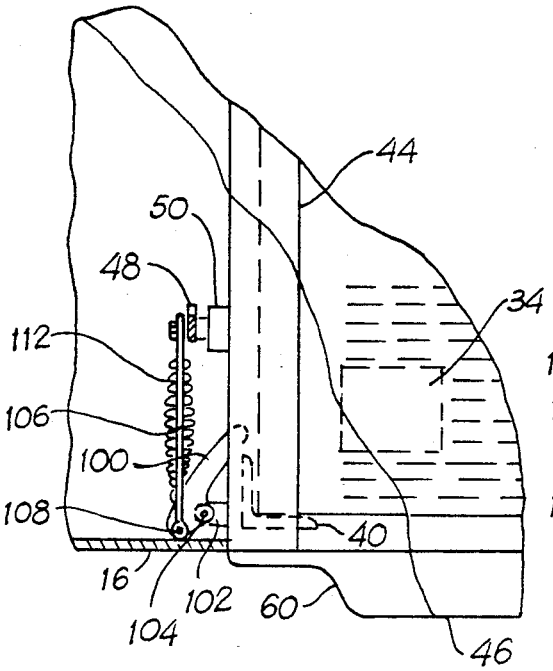
FIG. 14 is a top view of the rotating dispensing finger assembly of another embodiment of the invention illustrating the finger in its retracted position.
Figure 16:
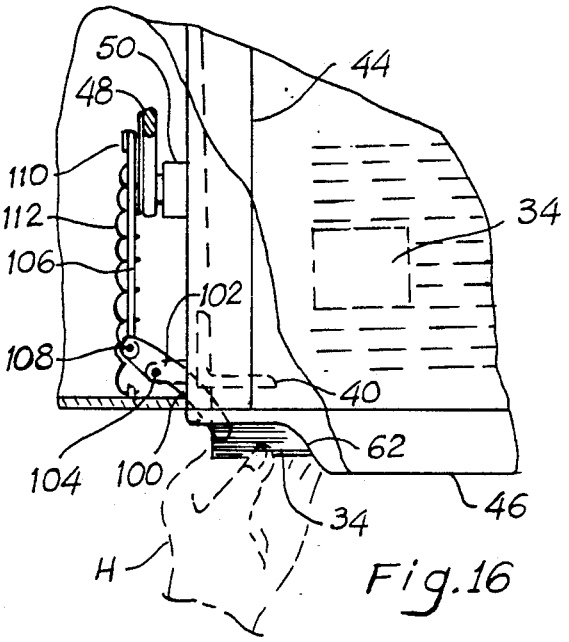
FIG. 16 is a top view of the rotating dispensing finger assembly of FIG. 14 illustrating the finger in its extended position through the dispensing slot.
Figure 15:
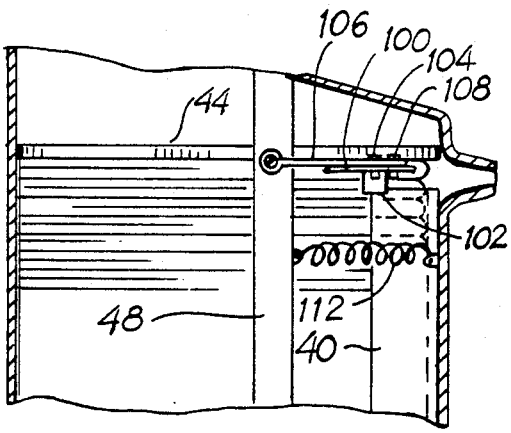
FIG. 15 is a side view of the portions of the dispensing assembly shown in FIG. 14.
Figure 17:
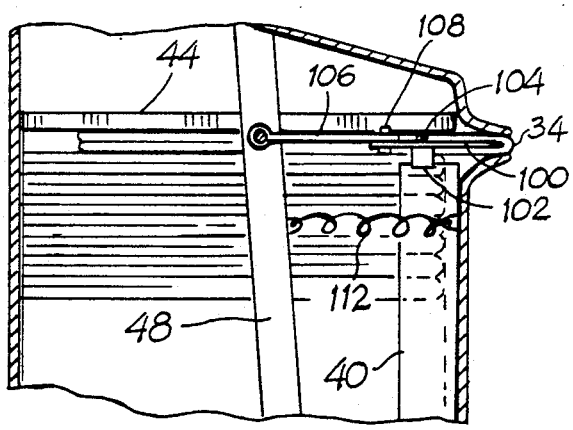
FIG. 17 is a side view of the portion of the invention shown FIG. 14.

In yet a different embodiment of the same concept of the invention, FIG. 14 illustrates in top view a finger mechanism with a different mechanical action that results in a faster release of the newspapers 36. Instead of having the finger 58 of the invention consisting of a structure rigidly attached to the arm 56 and protruding inward from the tip of the arm in a direction orthogonal to the vertical plane of the lever 48, the dispensing finger 100 consists of a separate structure hinged to a supporting block 102 mounted on the guide 40 (or otherwise attached to the cabinet 12). The finger 100 is hinged to the block 102 by means of a vertical bolt 104 ( or a rivet, or other means of attachment that would permit the finger to rotate on a horizontal plane) and the block 102 is positioned at an elevation that causes the tip of the finger to be lined up with the fold of the top newspaper in the stack. See the side view illustration of FIG. 15. The finger 100 is also connected to the dispensing lever 48 by means of a linkage rod 106 hinged by a bolt or rivet 108 to the end of the finger opposite to the tip of the finger and disposed in such a way as to cause the finger to swing through the slot 46 when the lever 48 is pushed toward the back of the cabinet. Notice that the dispensing lever and the support block 50 are not shown mounted at an angle in FIGS. 14 and 15, inasmuch as no particular position is a required feature for this embodiment of the invention so long as the action of the lever results in the rotation of the finger 100 on the horizontal plane passing through the fold of the top paper in the machine. FIGS. 16 and 17 illustrate the position of the lever and finger when the lever is pushed backwards to force a newspaper forward through the slot 46 and within the reach of a purchaser. The linkage rod 106 is also hinged on a stud 110 on the side of the lever 48 in order to permit the slight change in the angle it forms with the lever as the lever is moved back and forth. This change is well understood by comparing FIGS. 15 and 17. A spring 112 may be attached to the lever 48 and the wall of the cabinet to force the return of the lever to its forward position after each use, correspondingly causing the finger to return to its retracted position.

Thus, this embodiment of the invention is operated by pushing the dispensing lever backwards against the pull of the spring 112. As the lever moves back, the linkage rod 106 pulls one end of the finger 100 causing it to swing around the hinge 104, and causing the tip of the finger to engage the fold of the top newspaper in the stack stored in the machine. As the motion of the finger progresses, it pushes the engaged corner of the newspaper out of the slot 46, so that a user of the machine can grab it and fully extract it. When the lever is released, the spring 112 pulls it back and, through the linkage rod 106, it forces the finger 100 to return to its retracted position, clear of the stack of newspapers and in position for the next cycle of operation.

While any conventional means of construction is acceptable for the manufacture of the housing 12 of this vending machine, it is found that reinforced-fiberglass unibody construction is preferable because of its structural strength, light weight and relatively low cost. Many obvious particulars of the vending machine are not described here because they do not represent inventive subject matter, but rather simple solutions to well understood accessory requirements of the invention. For example, the apparatus may be wired for connection with a power source to provide illumination to the window 30; if so desired, sturdy guides or hinges may be used to support the front panel, and a lock may be provided to secure its closure.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

The embodiments of an invention in which an exclusive property or right is claimed are defined as follows:

1. A vending machine for dispensing newspapers stored in a stack supported by a spring-loaded tray housed in the interior of the machine, wherein a user by activating a dispensing lever causes the top newspaper in the stack to slide through a dispensing slot to a point where the paper can be reached and manually extracted from the machine, comprising the following components:

(a) a housing, comprising a front wall, a rear wall, a bottom panel, a top panel, a left wall, and a right wall; and including a lever slot in said to panel, two vertical guides affixed to the interior of the housing, and a horizontal dispensing slot having a top and a bottom edge in the front wall of the housing;

(b) a horizontal tray slideably mounted within said rear wall and said vertical guides for receiving a vertical stack of folded newspapers stored with their fold facing the front wall, said guides allowing the vertical travel of the tray between the bottom panel and the horizontal dispensing slot in the front wall;

(c) means for applying constant upward pressure on said tray sufficient to lift the stack of stored newspapers along said vertical guides;

(d) at least one transverse horizontal slat anchored to said housing at a position flush with the top edge of said dispensing slot and directly above said tray, so that said slat provides a retaining structure for the upward motion of the top newspaper in the stack stored on said tray;

(e) a dispensing lever hingedly mounted in a generally vertical position on the bottom panel of said housing, said lever having a handle at its top end and being sufficiently long to expose the handle through said lever slot in the housing's top panel; said lever being positioned at an angle with respect to the side walls of the housing, so that the arc formed by the motion of the lever, as it travels within the path allowed by said lever slot, lies in a vertical plane forming an acute angle with said side walls; and (f) a dispensing arm rigidly attached to and protruding forward from the dispensing lever at an approximate 90 degree angle on the vertical plane at an acute angle with said side walls, and a dispensing finger fixedly protruding inward from the tip of said arm in a direction orthogonal to the same vertical plane, so that the resulting structure is an approximately horizontal and L-shaped member rigidly attached to the dispensing lever and facing the front of the housing;

wherein said dispensing arm is affixed to the dispensing lever at the precise elevation required to cause the tip of said finger to correspond to the level of the fold of the top newspaper in the stack stored in said tray when the dispensing lever is fully retracted to its most backward position; wherein the exact angle of motion of the lever is chosen so that said finger engages the fold of the top newspaper and the arm is able to push it forward and penetrate the slot as the lever is pulled forward to its extended position, so that a portion of the arm, finger and newspaper protrude out of the housing through a portion of the slot; and wherein the motion of the finger is such that the finger automatically clears the stack of newspapers when the lever is in a retracted position.

2. The apparatus described in claim 1, further comprising an extension spring mounted between said lever and the back wall of said housing, so that the lever remains automatically in its retracted position unless pulled by the user against the force exerted by the spring.

3. The apparatus described in claim 1, further comprising a stop block mounted on said housing within the travel path of said lever in order to stop the extension of the dispensing finger at the most desirable point through said dispensing slot, namely at the point where the top newspaper in the stack stored in said tray is sufficiently exposed through the slot for the user to be able to grab it and pull it out of the machine.

4. The apparatus described in claim 1, wherein the portion of said dispensing slot corresponding to the location traveled by the dispensing finger as the lever is pulled forward features a partially cut notch to permit the partial exposure of the finger when fully extended forward.

5. The apparatus described in claim 1, wherein said dispensing lever is hingedly mounted on the bottom panel of said housing in such a manner that it becomes vertical when it is fully extended in its travel.

6. The apparatus described in claim 1, further comprising a screw adjustment incorporated into said dispensing arm consisting of a threaded channel machined into said dispensing lever for receiving a threaded screw inserted through an unthreaded coaxial channel machined into the arm, the two channels being so sized and aligned that the screw may be freely passed through the unthreaded channel and extended to the point where the screw's threads engage the threads of the threaded channel, so that the screw can be screwed into or out of the threaded channel by rotation in a clockwise or counterclockwise direction, respectively; said screw adjustment further consisting of two parallel annular grooves in said screw and of two square notches cut at both ends of said unthreaded channel in order to accommodate snap rings fitted in said grooves in order to prevent the longitudinal movement of the screw in relation to the arm; whereby the exact angle between the arm and the lever can be adjusted by the rotation of said screw, resulting in a corresponding adjustment of the position of the finger in alignment with the fold of the top newspaper in the stack for the proper functioning of the machine.

7. The apparatus described in claim 1, wherein said dispensing finger features a fine edge that facilitates the insertion of the finger into the fold of the top newspaper in the stack as the dispensing lever is pulled forward.

8. The apparatus described in claim 1, wherein said dispensing finger comprises a bifurcated end with a top and a bottom parallel tip, separated by a distance approximately equal to the average thickness of the newspapers sold by the vending machine, said top tip being positioned so that it loosely touches the underside of said at least one transverse horizontal slat when the dispensing arm is in its retracted position, so that said bottom tip is automatically lined up with the fold of the top newspaper in the stack.

9. The apparatus described in claim 1, further comprising a coin slot feeding a coin acceptor that automatically releases the dispensing lever for one cycle of operation when payment corresponding to the cost of a newspaper is made.

10. A vending machine for dispensing newspapers stored in a stack supported by a spring-loaded tray housed in the interior of the machine, wherein a user by activating a dispensing lever causes the top newspaper in the stack to slide through a dispensing slot to a point where the paper can be reached and manually extracted from the machine, comprising the following components:

(a) a housing, comprising a front wall, a rear wall, a bottom panel, a top panel, a left wall, and a right wall; and including a lever slot in said top panel, two vertical guides affixed to the interior of the housing, and a horizontal dispensing slot having a t-p and a bottom edge in the front wall of the housing;

(b) a horizontal tray slideably mounted within said rear wall and said vertical guides for receiving a vertical stack of folded newspapers stored with their fold facing the front wall, said guides allowing the vertical travel of the tray between the bottom panel and the horizontal dispensing slot in the front wall;

(c) means for applying constant upward pressure on said tray sufficient to lift the stack of stored newspapers along said vertical guides;

(d) at least one transverse horizontal slat anchored to said housing at a position flush with the top edge of said dispensing slot and directly above said tray, so that said slat provides a retaining structure for the upward motion of the top newspaper in the stack stored on said tray;

(e) a dispensing lever hingedly mounted in a generally vertical position on the bottom panel of said housing, said lever having a handle at its top end and being sufficiently long to expose the handle through said lever slot in the housing's top panel; and (f) a dispensing finger, having a tip and an end opposite to said tip, hingedly mounted on a support block so that the finger can rotate on a horizontal plane; said finger being connected to the dispensing lever by means of a linkage rod hinged to said opposite end, and being disposed in such a way as to cause the finger to swing through said dispensing slot when the lever is pushed toward the back of the housing;

wherein said dispensing finger is mounted on said support block at the precise elevation required to cause the tip of said finger to correspond to the level of the fold of the top newspaper in the stack stored in said tray; wherein the exact motion of the rotation of said finger is chosen so that the tip of the finger engages the fold of the top newspaper and is able to push it forward and penetrate the slot as the lever is pushed backwards, so that a portion of the finger and of the newspaper protrude out of the housing through a portion of the slot; and wherein the motion of the finger is such that the finger automatically clears the stack of newspapers when the lever is in a retracted position.

11. The apparatus described in claim 10, further comprising a spring attached to said dispensing lever and to said front wall of the housing to force the return of the lever to its forward position after each use, and correspondingly causing said finger to return to its retracted position; wherein said linkage rod is hinged on said dispensing lever in order to permit the change in the angle said rod forms with the lever during the cycle of operation.

12. A method of dispensing newspapers stored in a stack supported by a spring-loaded tray housed in the interior of a vending machine, wherein a user by activating a dispensing lever causes the top newspaper in the stack to slide through a dispensing slot to a point where the paper can be reached and manually extracted from the machine, comprising the following steps:

(a) providing a housing, comprising a front wall, a rear wall, a bottom panel, a top panel, a left wall, and a right wall; said housing also including a lever slot in said to panel, two vertical guides affixed to the interior of the housing, and a horizontal dispensing slot having a top and a bottom edge in the front wall of the housing;

(b) mounting a slidable horizontal tray within said rear wall and said vertical guides for receiving a vertical stack of folded newspapers stored with their fold facing the front wall, said guides allowing the vertical travel of the tray between the bottom panel and the horizontal dispensing slot in the front wall;

(c) providing means for applying constant upward pressure on said tray sufficient to lift the stack of stored newspapers along said vertical guides;

(d) providing at least one transverse horizontal slat anchored to said housing at a position flush with the top edge of said dispensing slot and directly above said tray, so that said slat provides a retaining structure for the upward motion of the top newspaper in the stack stored on said tray;

(e) mounting a hinged dispensing lever in a generally vertical position on the bottom panel of said housing, said lever having a handle at its top end and being sufficiently long to expose the handle through said lever slot in the housing's top panel; said lever being positioned at an angle with respect to the side walls of the housing, so that the arc formed by the motion of the lever, as it travels within the path allowed by said lever slot, lies in a vertical plane forming an acute angle with said side walls;

(f) providing a dispensing arm rigidly attached to and protruding forward from the dispensing lever at an approximate 90 degree angle on the vertical plane at an acute angle with said side walls, said arm having a dispensing finger fixedly protruding inward from the tip of said arm in a direction orthogonal to the same vertical plane, so that the resulting structure is an approximately horizontal and an L-shaped member rigidly attached to the dispensing lever and facing the front of the housing; wherein said dispensing arm is affixed to the dispensing lever at the precise elevation required to cause the tip of said finger to correspond to the level of the fold of the top newspaper in the stack stored in said tray when the dispensing lever is fully retracted to its most backward position; wherein the exact angle of motion of the lever is chosen so that said finger engages the fold of the top newspaper and the arm is able to push it forward and penetrate the slot as the lever is pulled forward to its extended position, so that a portion of the arm, finger and newspaper protrude out of the housing through a portion of the slot; and wherein the motion of the finger is such that the finger automatically clears the stack of newspapers when the lever is in a retracted position;

(g) pulling said dispensing lever forward to cause said finger to engage the fold of the top newspaper in the stack and to push it forward and penetrate the slot as the lever is pulled forward to its extended position, so that a portion of the newspaper protrudes out of the housing through said horizontal slot; and (h) extracting the newspaper from the machine and returning the lever to its retracted position.

13. The method described in claim 12, further comprising the step of providing an extension spring mounted between said lever and the back wall of said housing, so that the lever remains automatically in its retracted position unless pulled by the user against the force exerted by the spring.

14. The method described in claim 12, further comprising the step of providing a stop block mounted on said housing within the travel path of said lever in order to stop the extension of the dispensing finger at the most desirable point through said dispensing slot, namely at the point where the top newspaper in the stack stored in said tray is sufficiently exposed through the slot for the user to be able to grab it and pull it out of the machine.

15. The method described in claim 12, wherein the portion of said dispensing slot corresponding to the location traveled by the dispensing finger as the lever is pulled forward features a partially cut notch to permit the partial exposure of the finger when fully extended forward.

16. The method described in claim 12, wherein said dispensing lever is hingedly mounted on the bottom panel of said housing in such a manner that is becomes vertical when it is fully extended in its travel.

17. The method described in claim 12, further comprising the step of providing a screw adjustment incorporated into said dispensing arm consisting of a threaded channel machined into said dispensing lever for receiving a threaded screw inserted through an unthreaded coaxial channel machined into the arm, the two channels being so sized and aligned that the screw may be freely passed through the unthreaded channel and extended to the point where the screw's threads engage the threads of the threaded channel, so that the screw can be screwed into or out of the threaded channel by rotation in a clockwise or counterclockwise direction, respectively; said screw adjustment further consisting of two parallel annular grooves in said screw and of two square notches cut at both ends of said unthreaded channel in order to accommodate snap rings fitted in said grooves in order to prevent the longitudinal movement of the screw in relation to the arm; whereby the exact angle between the arm and the lever can be adjusted by the rotation of said screw, resulting in a corresponding adjustment of the position of the finger in alignment with the fold of the top newspaper in the stack for the proper functioning of the machine.

18. The method described in claim 12, wherein said dispensing finger features a fine edge that facilitates the insertion of the finger into the fold of the top newspaper in the stack as the dispensing lever is pulled forward.

19. The method described in claim 12, wherein said dispensing finger comprises a bifurcated end with a top and a bottom parallel tip, separated by a distance approximately equal to the average thickness of the newspapers sold by the vending machine, said top tip being positioned so that it loosely touches the underside of said at least one transverse horizontal slat when the dispensing arm is in its retracted position, so that said bottom tip is automatically lined up with the fold of the top newspaper in the stack.

20. The method described in claim 12, further comprising the step of providing a coin slot feeding a coin acceptor that automatically releases the dispensing lever for one cycle of operation when payment corresponding to the cost of a newspaper is made.

* * * * *